US008757623B2

(12) United States Patent
Harrison et al.

(10) Patent No.: US 8,757,623 B2
(45) Date of Patent: Jun. 24, 2014

(54) BOARD GAMES

(75) Inventors: James Harrison, Barnet (GB); Michael Bucher, Norfolk (GB)

(73) Assignee: Bucher and Harrison Limited (GB)

( * ) Notice: Subject to any disclaimer, the term of this patent is extended or adjusted under 35 U.S.C. 154(b) by 0 days.

(21) Appl. No.: 12/997,030

(22) PCT Filed: Jun. 9, 2009

(86) PCT No.: PCT/GB2009/050646

§ 371 (c)(1),
(2), (4) Date: May 9, 2011

(87) PCT Pub. No.: WO2009/150457

PCT Pub. Date: Dec. 17, 2009

(65) Prior Publication Data

US 2011/0260400 A1 Oct. 27, 2011

(30) Foreign Application Priority Data

Jun. 9, 2008 (GB) ..... 0810501.7
Feb. 5, 2009 (GB) ..... 0901859.9

(51) Int. Cl.
*A63F 3/00* (2006.01)

(52) U.S. Cl.
USPC ..... 273/282.3; 273/288; 273/290

(58) Field of Classification Search
USPC ..... 273/281, 281.1, 288, 290, 282.3, 287, 273/289, 291, 275
See application file for complete search history.

(56) References Cited

U.S. PATENT DOCUMENTS

| | | | | | |
|---|---|---|---|---|---|
| 1,598,525 | A | | 8/1926 | Holt | |
| 3,404,890 | A | * | 10/1968 | Christy | 273/241 |
| 3,606,335 | A | | 9/1971 | Reiner | |
| 4,436,309 | A | * | 3/1984 | Barlow et al. | 273/267 |
| 4,776,597 | A | * | 10/1988 | Rudell | 273/241 |
| 4,819,945 | A | | 4/1989 | Porcheddu | |
| 4,993,984 | A | * | 2/1991 | Matarese | 446/118 |

FOREIGN PATENT DOCUMENTS

| | | |
|---|---|---|
| GB | 1446840 | 8/1976 |
| WO | WO-00/10660 A1 | 3/2000 |

* cited by examiner

*Primary Examiner* — Vishu K. Mendiratta

(74) *Attorney, Agent, or Firm* — Barnes & Thornburg LLP

(57) ABSTRACT

Tiles (7) having significant depth are placed on a gameboard (1) having projections (2) on its upper surface. The protrusions (2) engage recesses (8) formed on the corners of the tiles (7) in order to locate the tiles (7) in position on the game board (1). The recesses (8) may extend for only part of the depth of the tiles (7) so that they are not visible from the top of the tiles (7), thereby affording visual continuity between the (tiles 7). The protrusions (2) may engage the recesses (8) as a friction fit, to hold the tiles (7) firmly in place. Alternatively, they may engage the recesses (8) as a loose fit, thereby to afford location of the tiles (7) while allowing their easy removal from the game board (1).

20 Claims, 4 Drawing Sheets

BOARD GAMES

The present invention relates to board games.

Board games often require playing pieces to be retained on a game board whilst other playing pieces are likewise placed on the board.

For example, the well-known board game Scrabble involves the placement of square letter tiles to form words within corresponding sized squares on a game board. Aligning letter tiles to form a row, interconnected with other rows of tiles, can prove difficult. Words must be built using the letter tiles of existing words on the board, and therefore they must be placed adjacent to each other, making it difficult to align them all both vertically from top to bottom and horizontally across the game board. Tiles easily become knocked and shifted out of alignment. The board might be accidentally jolted or moved, which again can shift the tiles out of alignment and potentially put a premature end to a game in progress. Players often rotate the board so that words formed from the letter tiles, placed on its surface, are easier to read. This rotation of the board can again cause tiles to be moved out of their playing squares.

In the context of this specification, the term "board game" means a game for one or more players, wherein playing pieces are placed on a game board in accordance with rules of the game. The game play may involve luck, skill, strategy or ingenuity to win the game. Optionally, playing pieces may be moved to different positions on the board, after being placed on the board. The board may be of any suitable construction. One-player board games are often referred to as "puzzles", which are included within the ambit of the term "board game" as used herein.

Board games that involve placing and rearranging game pieces on the surface of the game board are often available in travel versions for use when on the move. They are designed to be played, for example, in the back of a car, or in-flight. In these situations, the board is more likely to be jolted about or knocked, and the playing surface is likely to be inclined to the horizontal. It is often necessary to put the game on hold, therefore leaving the game pieces that have already been placed on the game board in position, to resume at a later time. Existing products allow for these circumstances—for example, by the use of a magnetic game board with magnetic playing pieces, or by forming a raised plastic grid on the surface of the board, into which the game pieces can be clipped. Whilst these methods help to prevent the game pieces from shifting, and aim to keep them in the positions in which they were originally placed, they are far more expensive to manufacture than the standard game board arrangement, which is typically made from cardboard or other paper composite. Even with labelling and lamination processes, the production of such standard game boards is highly economical. Therefore, introducing magnetic layers, magnetic pieces and/or additional plastics mouldings into the manufacturing process greatly increases both the cost of materials, and the complexity of production.

Manufacturers of board games strive to meet tight price points, and must also ensure that their board games fit within standard sized packaging boxes, to accommodate both shipping and in-store shelf requirements. The majority of game boards are therefore made from laminated cardboard or, in the case of travel versions, moulded plastic. Both versions are typically designed to fold in half, the travel version often being hinged for this purpose. Whilst a card-laminated board can be directly printed with the necessary graphics for playing a particular game, the plastic travel version requires an additional adhesive sticker to display these graphics.

Cardboard laminated boards can suffer from all of the problems as identified above, in that any movement of the board causes any playing pieces placed on them to shift from their original position. They can also become easily damaged or torn and, after some use, graphics can be worn away, to make playing squares, instructions or graphic images unreadable. Plastic game boards are far more hard-wearing than cardboard versions.

Those cardboard laminated game boards that solve the problem of alignment of playing pieces, by incorporating a raised plastic grid, joined with adhesive or other means to the playing surface, suffer from difficulties such as being unable to be folded into two. The playing pieces are often snapped into the grid, to hold them in place, thereby making them difficult to remove should they be wrongly placed.

Game boards are known that incorporate a plurality of holes throughout the playing surface, with a corresponding peg protruding from the base of each playing piece. Whilst this allows playing pieces to be aligned, it does not secure them in position, and siting the peg within the hole can prove difficult. The holes within the board, typically made from laminated cardboard, can become worn and, since each playing piece is only supported in one place, can be rotated or moved out of alignment.

Where holes are located across the surface of the game board, the graphics displayed on the board become interrupted. For example, by placing a hole in the centre of every square on a Scrabble board, the graphics in each square become far harder to read.

There is also an issue with those game boards that incorporate a plastic grid adhered to their surface, in that when playing pieces or tiles are placed adjacent to each other, the width of the grid forms a spacer between the playing pieces. With games such as Scrabble, the letter tiles are assembled into rows and columns to form words, but with the grid forming a space between each letter tile, words become harder to read, and do not appear to flow.

The prior art shows a number of ways of attempting to solve these problems, both in products that are on the market, and in patent literature.

U.S. Pat. No. 4,252,323 (Levinrad) identifies the problem with existing game boards when they become accidentally moved, and attempts to solve the problem by incorporating demarcations on the board such as rib formations or recesses, into which the playing tiles can be located. However the protrusions from the playing tiles can be broken away, and the recesses within the game board, typically made from cardboard, can become worn with use, securing the playing tiles less and less with wear.

Often a plastic framework is supplied secured to the surface of the playing board for receiving game pieces placed thereon and restraining the game pieces against unintended vertical or horizontal displacement—e.g. U.S. Pat. No. 5,087,052 (Simon), which shows a see-through grid disposed within a frame for releasably receiving the game pieces. However the board when formed like this cannot be folded in half to place within box packaging, thus requiring a larger square box, and vastly increasing production costs. The grid breaks up the flow of tiles, and for games where words are formed, makes these words harder to read due to the gaps or spaces between tiles.

GB 2,117,255 (Weinreb) proposes a margin surrounding each of the playing squares, enabling the tiles to be removed and replaced without disturbing tiles occupying neighbouring squares. The centre of each square on the board is provided with a hole, and a peg on the base of each tile corresponds with each hole to secure the tile from two-dimensional movement. However the words are interrupted with spaces in between each tile, and the holes within the centre of each playing square affect the graphics printed thereon.

U.S. Pat. No. 1,598,525 (Holt) proposes a game board carrying a plurality of pegs at uniformly spaced intervals, the pegs projecting from the face of the board. Cards have corners cut away in quarter-circle formation for frictional engagement with the pegs, to hold the cards in position on the face of the board. The cards also have semicircular holes on opposing sides, into which a tool can be inserted in order to prise the cards out of engagement with the pegs for removal. Whilst the friction-engaging pegs are useful for holding the cards in place, the requirement of a tool to remove the cards is inconvenient, but clearly necessary due to the thinness of the cards. When a game is completed, it is time consuming to remove all of the cards.

In summary, existing means of retaining playing pieces on a game board of which we are aware inevitably require large increases in production costs and/or interrupt the game play of the board game.

Preferred embodiments of the present invention aim to provide a game board and playing pieces that incorporate means such as protrusions and recesses to interconnect with each other, thereby retaining the playing pieces in the required position. In contrast to known methods of aligning and retaining playing pieces, they recognise the fact that production costs must be kept to a minimum, whilst the game play must not be affected by any additional elements. Therefore, they set out to provide a means of retaining tiles that uses cost effective manufacturing processes, whilst creating a simple yet effective way to locate the playing pieces in the required position on the game board. Preferred embodiments of the present invention may incorporate one or more recesses or notches about the periphery of polygonal tiles, preferably in the corners, to correspond with small protrusions moulded into a plastics game board.

According to one aspect of the present invention, there is provided a game board and playing pieces, wherein:

said game board has a playing surface that is provided with a plurality of protrusions;

each of the playing pieces comprising a tile that incorporates at least one recess about its periphery; and said tiles are placed on the board with said recesses engaging said protrusions to inhibit movement of the tiles across the game board.

Preferably, said game board comprises a plastics material.

Preferably, said game board is injection moulded.

Preferably, said game board has graphics printed thereon.

A label may be affixed to said game board to display graphics.

Said graphics may comprise a grid of playing squares.

A protrusion may be provided at every intersection point of said grid.

The tiles may be polygons.

Said tiles may be square.

Preferably, each of the tiles incorporates a recess at least two corners of the tile.

Each of said tiles may incorporate a recess at each of its corners.

Each of said recesses may be shorter than the depth of the tile.

Preferably, each of said recesses extends for a distance of 20%, 30%, 40%, 50%, 60%, 70% or 80% of the depth of the respective tile.

Preferably, said tiles are of injection moulded plastics.

Graphics may be provided on the tiles.

Said graphics on the tiles may comprise letters of the alphabet.

The game board and playing pieces may be adapted for playing the game of Scrabble.

The recesses may engage the protrusions as a friction fit to hold the tiles firmly in engagement.

Alternatively, the recesses may engage the protrusions as a loose fit to afford location of the tiles on the game board.

At least some of said protrusions may engage a plurality of said recesses on a plurality of said tiles.

Preferably, each of the tiles has a depth that is equal to at least 20%, 30%, 40% or 50% of the longest dimension of the tile.

Preferably, each of said recesses has a radius in the range 5% to 15% of the longest dimension of the respective tile.

For a better understanding of the invention an to show how embodiments of the same may be carried into effect, reference will now be made, by way of example, to the accompanying diagrammatic drawings, in which.

Figure 1:
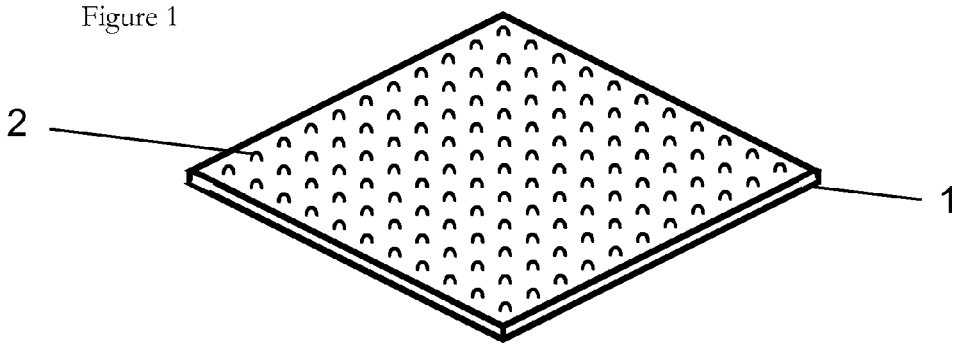
FIG. 1 illustrates one example of an embodiment of a game board, in isometric view.
Figure 3A:
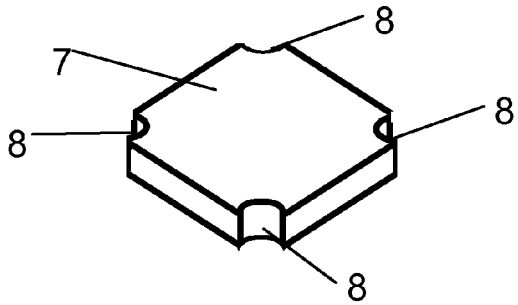
Figure 3B:
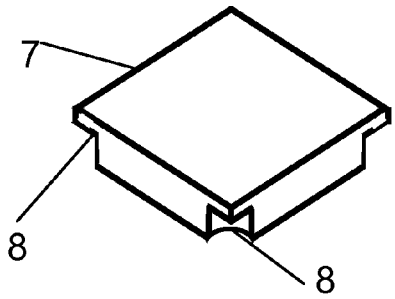
Figure 4:
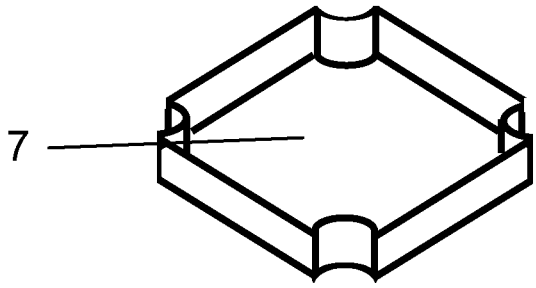
Figure 5A:
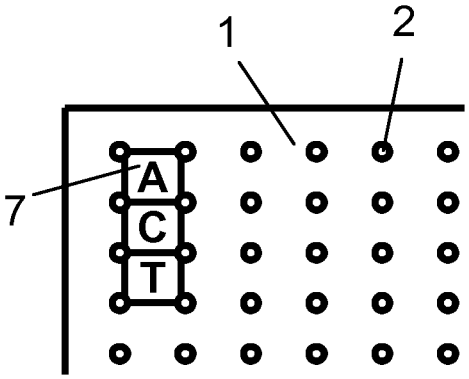
Figure 5B:
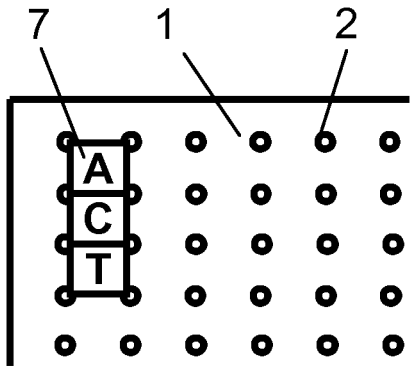

FIG. 3*a* shows a square tile in isometric view with full corner recesses, and FIG. 3*b* shows a further square tile with part (blind) corner recesses;

FIG. 4 shows the square tile of FIG. 3 in isometric view from the underside;

FIG. 5*a* shows the game board of FIG. 1 locating three tiles of FIG. 3*a* in position, FIG. 5*b* showing in a corresponding manner three tiles of FIG. 3*b;*

Figure 6:
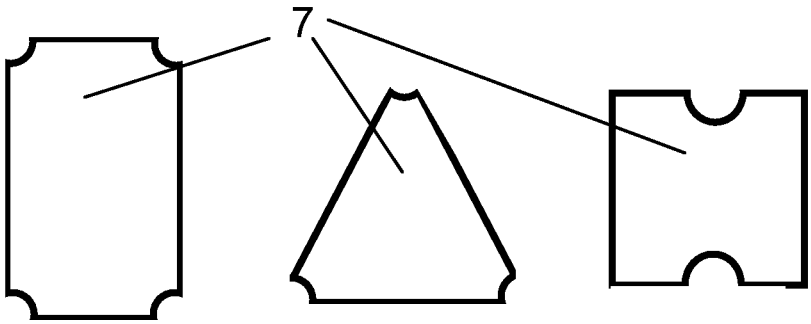
Figure 7:
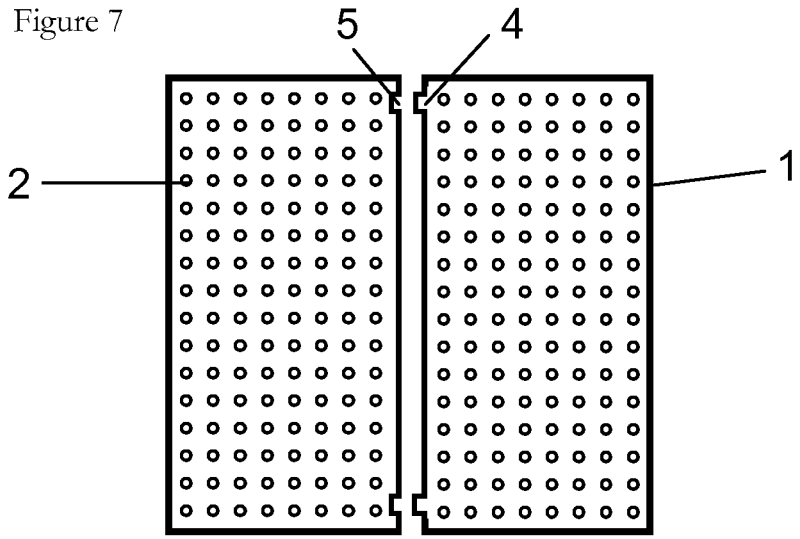
Figure 8:
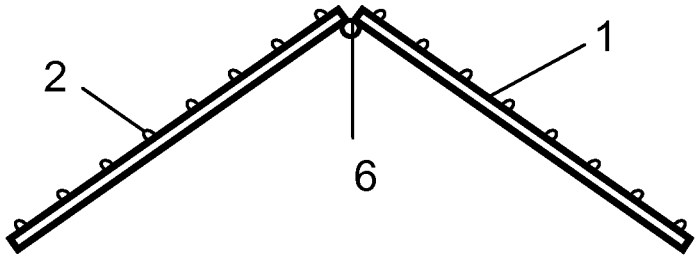
Figure 9:
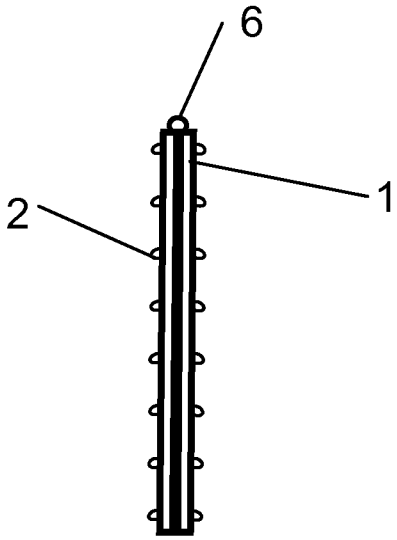
Figure 10:
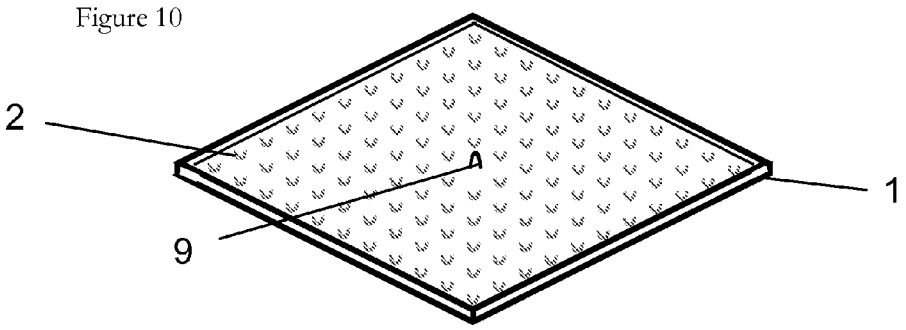
Figure 11:
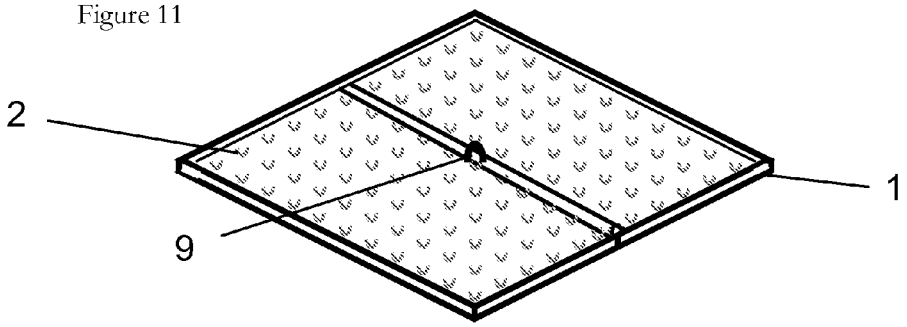

FIG. 6 shows a plurality of different polygonal tiles;

FIG. 7 shows one example of joining the game board in two halves;

FIG. 8 shows a hinged game board;

FIG. 9 shows the hinged game board of FIG. 8 folded flat;

FIG. 10 shows the game board of FIG. 1 in isometric view from the underside, with a base protrusion to enable board rotation; and FIG. 11 shows the hinged game board with the base protrusion.

In the figures, like references denote like or corresponding parts.

FIGS. 1 to 5 illustrate a game board 1 and playing pieces or tiles 7 for use in playing the well-known board game Scrabble. The game of Scrabble is well known throughout the world, being sold in over 120 countries, and is thought to have first appeared on the market in 1938. The game is for 2 to 4 players, and is played on a square game board 1, as shown in FIG. 1, marked with a fifteen by fifteen grid of playing squares. Each player is given seven letter tiles 7, which they keep concealed from the other players. The aim of the game is to create words out of the letter tiles 7, from either top to bottom on the game board 1 or from left to right. Once placed on the game board 1, the tiles 7 are replaced so that each player always has seven, until the tiles are exhausted. Players score points by forming words and enhance their scores by passing through bonus squares in the grid, and by using letter tiles 7 that are less common in the dictionary, and therefore harder to construct words out of. The words must interconnect with existing words on the game board 1, and therefore must cross over or meet playing squares that have a letter tile 7 contained within. Each playing square marked on the game board 1 accommodates a single letter tile 7.

The illustrated game board and playing pieces have been designed to be used with the board game Scrabble and the rules associated with such a game, although it should be noted that the invention is not limited to such a board game, and other embodiments may apply to other board games and puzzles that require playing pieces to be positioned on a game board or such like, and in which a means of supporting playing pieces in the position in which they are placed is advantageous.

Figure 2:
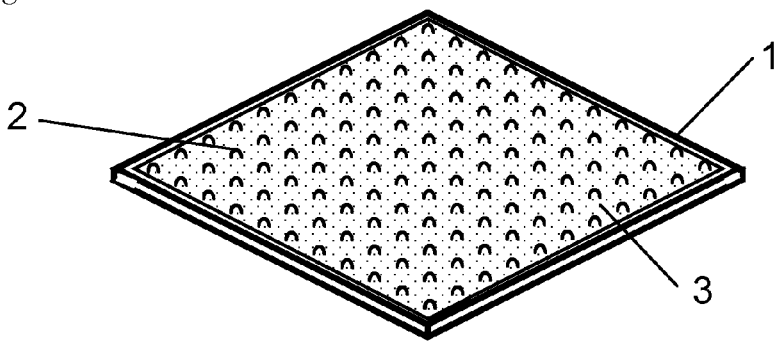
FIG. 2 shows the game board of FIG. 1 in isometric view, with one example of labelling.

FIGS. 1 and 2 show one embodiment of a game board 1 that is injection moulded from a plastics material, for example, High Impact Polystyrene (HIPS) or Acrylonitrile Butadiene Styrene (ABS). A number of protrusions 2 are moulded into the game board 1, each of these protrusions 2 being at the intersection points of playing squares. The protrusions 2 projecting from the game board 1 can be of any three dimensional shape—for example, cylindrical, conical or cuboid. The protrusions 2 may be tapered; the edges and corners may be bevelled or rounded. The playing squares will either be printed directly onto the game board 1, or a label 3 secured to the surface through adhesive or other means as shown in FIG. 2. The label 3 may be of paper, cardboard or vinyl and may be laminated for durability.

A playing piece or tile 7, as shown in FIGS. 3 and 4, may be formed by injection moulding of a plastics material, such as High Impact Polystyrene (HIPS) or Acrylonitrile Butadiene Styrene (ABS). Each tile 7 displays the required graphics, which in the game of Scrabble is an individual letter, this being printed directly onto the tile 7 by means such as hot foil or silk-screen printing.

In contrast to game cards (such as disclosed in U.S. Pat. No. 1,598,525 for example), each of the tiles 7 has significant thickness or depth, such that it may conveniently be picked up by hand. For example, a tile that is 16 mm square may have a depth of 5 mm. That is, the depth is about 30% of the dimension of the square. Preferably, the thickness of the tile is at least 20% of the dimension of the square or is at least 3 mm. The thickness of the tile may be in the range 20% to 50% of the longest dimension of the tile.

The tiles 7 incorporate a plurality of recesses 8 about their periphery, as shown in FIGS. 3 and 4. These figures show a square tile 7, with curved recesses 8 at each corner of the tile 7, the shape of the recesses 8 corresponding to that of the protrusions 2. The shape of the protrusions 2 is such that each protrusion 2 fits with one or more recess 8. In a preferred embodiment, the protrusions 2 are shaped to fit against the recesses 8, each protrusion 2 being capable of engaging four tiles 7 (but actually engaging less than four tiles 7 around the edges of the game board 1). In FIG. 3*a*, the recesses extend the full depth of the tile 7. In FIG. 3*b*, the recesses 8 are "blind", extending for only part of the depth of the tile 7.

FIG. 5*a* shows three square letter tiles 7 adjacent to each other to form a word, whereby each tile 7, with a recess 8 at each corner, is located adjacent a protrusion 2 at each corner. Thus, once the tiles 7 have been placed in position on the game board 1, they are automatically aligned in both a vertical and horizontal direction within the playing squares that make up the grid. FIG. 5*b* is similar to FIG. 5*a*, but shows tiles 7 having blind recesses 8 as illustrated in FIG. 3*b*, such that the visible faces of the tiles 7 make up a less discontinuous surface.

If desired, there may be a friction fit between the protrusions 2 and recesses 8. This enables the tiles 7 to remain firmly in position when the game board 1 is moved, which is advantageous for a travel version of the game. For example, it may be possible to invert the board 1 with played tiles 7 remaining in position.

On the other hand, for normal play, it may be advantageous for there to be a loose fit between protrusions 2 and recesses 8, such that there is a small amount of play in the positions of the tiles 7. In such an embodiment, the protrusions 2 and recesses 8 interengage sufficiently for the tiles 7 to be positively located on the game board 1, resistant to sideways motion if either the board 1 or the pieces 7 are knocked. However, in the absence of a friction fit, the tiles 7 can more readily be removed from the game board 1. In particular, at the end of a game, the game board 1 can simply be inverted to allow the tiles 7 to drop off the board, ready to start a new game or to be packed away. This is particularly advantageous where the tiles 7 have blind recesses 8 as illustrated in FIG. 3*b*. Where there is a loose fit between protrusions 2 and recesses 8, adjacent tiles 7 may also cooperate to keep each other in position as the game progresses.

With a game such as Scrabble, the game board 1 soon has on its surface a series of interconnecting words formed from individual letter tiles 7. Each player places their tiles 7 onto the board, adjacent to other tiles 7 that are already on the game board 1. The protrusions 2 inhibit movement of the tiles 7, through engagement with their recesses 8, so that if tiles 7 accidentally become knocked, or the game board 1 itself is jolted in some way, the tiles 7 tend to remain in alignment.

A game being played may need to be paused and returned to at a later time and, in this instance, it is important that the tiles 7 remain in the playing squares on the playing board 1 in which they have been placed. Providing the recesses 8 in the tiles 7 are interconnected with the protrusions 2 on the game board 1, as either a friction fit or a loose fit, they will remain in position and alignment until the game is resumed.

The tiles 7 may be of any shape, and three other examples are shown in FIG. 6. Should a game require tiles 7 of a different shape, such as other polygons, circles or non-uniform shapes then, providing that recesses 8 are provided about the periphery of the tiles 7, designed to correspond with the shape and size of protrusions 2 on the game board 1, other embodiments need not be limited to a square tile format, as described with reference to board games such as Scrabble. The recesses 8 need not be positioned in the corners of tiles 7, and could be located elsewhere about the perimeter of a tile 7.

As indicated above, the recesses 8 of the tiles 7 need not be moulded right through the tiles 7, providing there is a sufficient recess 8 to fit against a corresponding protrusion 2. Therefore, from the top surface of the tiles 7, the recesses 8 need not appear visible, as illustrated in FIGS. 3*b* and 5*b*. Such an arrangement of "blind" holes may be particularly pleasing aesthetically and, as indicated above, words may be easier to read with less discontinuity between tiles 7. Also, if blind recesses 8 are shorter, then the protrusions 2 will be correspondingly shorter. In turn, this affords more pleasing aesthetics and less visual discontinuity to the game board 1, as well as requiring less plastics (or other material) to form the protrusions 2.

By way of example, for a tile 7 of approximately 16 mm square dimension and 5 mm thickness (depth), blind recesses 8 may extend for a distance of approximately 3 mm, or about 60% of the thickness of the tile. In general, recesses such as 8 may extend for a distance of about 20% to 80% of the thickness of a tile such as 7.

The recesses such as 8 need not be of very great radius. In the example just given above, they may have a radius of about 1 mm, with the corresponding protrusions such as 2 having a diameter of about 1.5 mm and a height of about 2.5 mm to afford a loose fit for location, or a diameter of about 2 mm to afford a friction fit for more secure fixing. In general, recesses such as 8 may have a radius in the range 5% to 15% of the longest dimension of a tile such as 7.

Tiles may have a longest dimension in the range 10 mm to 40 mm, preferably 10 mm to 20 mm.

Where the recesses such as 8 extend for the full depth of the tiles 7, the height of the protrusions 2 may be equal to or less than the depth of the tiles 7. Thus, the protrusions do not protrude above the top surfaces of the tiles 7. The height of the protrusions 2 may be substantially equal to the depth of the tiles 7, such that the tops of the protrusions 2 are approximately co-planar with the top surfaces of the tiles 7. Thus, an aesthetically pleasing appearance may be provided. The tops of the protrusions 2 may have the same colour as the tiles 7, so that they blend in. Alternatively, they may be of different colours, either for aesthetic reasons, or for game play reasons. For example, at least the tops of four protrusions 2 at the respective corners of a pink-coloured bonus square may also be coloured pink. In this way, the position of the pink bonus square may be seen, even with a tile 7 played on it. The tops of the protrusions may be of more than one colour, adjacent different, correspondingly coloured squares on the game board 1.

The game board 1 need not be two-dimensional as illustrated in FIGS. 1 and 2, but may be curved or three dimensional in construction. Likewise the playing pieces or tiles 7 need not be flat, but may be curved to correspond with the shape of the game board 1 or to provide any desired appearance.

For storage purposes, and in particular for use with travel versions of board games, the game board 1 may be designed to fold or to come apart into two or more parts. FIGS. 7 to 9 show two possible ways of achieving this. It is often the case that board game manufacturers must fit the game board 1 into an existing packaging box size, for both shipping and shelf storage purposes.

FIG. 7 shows a modified version of the game board 1 of FIG. 1, having been formed in two halves. In this embodiment, the two halves of the game board 1 with protrusions 2 are designed to join together by means of a plurality of co-operating spigots 4 and sockets 5. Various different releasable joining methods could be adopted.

FIGS. 8 and 9 show another modified version of the game board 1, again formed in two halves, but incorporating a hinge 6 that joins the two halves whilst allowing the two halves to fold flat against each other, halving the width of the game board 1. The hinge 6 may comprise a flexible tape, moulded plastic portion or such like.

FIGS. 10 and 11 show a small base protrusion 9, both on a game board 1 and a game board 1 with a hinge 6. The base protrusion 9 forms part of the moulding in both cases, and provides in a very simple manner a pivot point that allows for rotation of the game board 1 to face each player when it is their turn. This simple means to rotate the game board 1 obviates the need to lift and turn the game board 1, and allows each player to have a view of the letter tiles 7, and the words that have been formed, the right way up.

Where the game board 1 is of moulded plastics, the hollow internal portions of the game board 1 can be used for storage of playing pieces or tiles 7, particularly where the game board 1 is designed to fold into two halves.

"Scrabble" is a Registered Trade Mark.

In this specification, the verb "comprise" has its normal dictionary meaning, to denote non-exclusive inclusion. That is, use of the word "comprise" or any of its derivatives) to include one feature or more, does not exclude the possibility of also including further features.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A game board and playing pieces:

a. said game board having a playing surface from which a plurality of protrusions project;

b. each of said playing pieces comprising a tile having length, width and thickness and incorporating at least one recess about its periphery;

c. said recesses engaging said protrusions to inhibit movement of the tiles across the game board when the tiles are placed on the board;

d. said recesses extending for only part of the thickness of the tiles; and e. said tiles, when placed on the board, covering at least a portion of each protrusion adjacent said tiles; and f. at least some of said protrusions having a top surface facing a portion of a bottom surface of said recesses of more than one of said tiles.

2. A game board and playing pieces according to claim 1, wherein said game board comprises a plastics material.

3. A game board and playing pieces according to claim 2, wherein said game board is injection moulded.

4. A game board and playing pieces according to claim 1, wherein said game board has graphics printed thereon.

5. A game board and playing pieces according to claim 4, wherein said graphics comprise a grid of playing squares.

6. A game board and playing pieces according to claim 5, wherein a protrusion is provided at every intersection point of the grid.

7. A game board and playing pieces according to claim 1, wherein a label is affixed to said game board to display graphics.

8. A game board and playing pieces according to claim 1, wherein said tiles are polygons.

9. A game board and playing pieces according to claim 1, wherein said tiles are square.

10. A game board and playing pieces according to claim 1, wherein each of said tiles incorporates a said recess at at least two corners of the tile.

11. A game board and playing pieces according to claim 1, wherein each of said tiles has a said recess at each of its corners.

12. A game board and playing pieces according to claim 1, wherein each of said recesses extends for a distance of 20%, 30%, 40%, 50%, 60%, 70% or 80% of the thickness of the respective tile.

13. A game board and playing pieces according to claim 1, wherein said tiles are of injection moulded plastics.

14. A game board and playing pieces according to claim 1, wherein graphics are provided on said tiles.

15. A game board and playing pieces according to claim 14, wherein said graphics on said tiles comprise letters of the alphabet.

16. A game board and playing pieces according to claim 1, adapted for playing the game of Scrabble.

17. A game board and playing pieces according to claim 1, wherein said recesses engage said protrusions as a friction fit to hold the tiles firmly in engagement.

18. A game board and playing pieces according to claim 1, wherein said recesses engage said protrusions as a loose fit to afford location of the tiles on the game board.

19. A game board and playing pieces according to claim 1, wherein each of said tiles has a thickness that is equal to at least 20%, 30%, 40% or 50% of the longest dimension of the tile.

20. A game board and playing pieces according to claim 1, wherein each of said recesses has a radius in the range 5% to 15% of the longest dimension of the respective tile.

* * * * *